US009415317B2

(12) United States Patent
Hatfield

(10) Patent No.: US 9,415,317 B2
(45) Date of Patent: Aug. 16, 2016

(54) TEETER-TOTTER DEVICE

(71) Applicant: Luke Hatfield, Saint John (CA)

(72) Inventor: Luke Hatfield, Saint John (CA)

( * ) Notice: Subject to any disclaimer, the term of this patent is extended or adjusted under 35 U.S.C. 154(b) by 0 days.

(21) Appl. No.: 14/850,336

(22) Filed: Sep. 10, 2015

(65) Prior Publication Data

US 2016/0089609 A1 Mar. 31, 2016

Related U.S. Application Data

(60) Provisional application No. 62/055,182, filed on Sep. 25, 2014.

(51) Int. Cl.
*A63G 11/00* (2006.01)

(52) U.S. Cl.
CPC ..... *A63G 11/00* (2013.01)

(58) Field of Classification Search
CPC ..... A63G 11/00
See application file for complete search history.

(56) References Cited

U.S. PATENT DOCUMENTS

| | | | | |
|---|---|---|---|---|
| 1,550,040 | A * | 8/1925 | Nagy | A63G 11/00 472/112 |
| 5,776,002 | A | 7/1998 | Weber | |
| 5,951,406 | A * | 9/1999 | Steane | A63G 11/00 434/194 |
| 7,026,900 | B1 * | 4/2006 | Gregory | H02K 57/006 310/15 |
| 7,220,184 | B1 | 5/2007 | Akers | |
| 7,413,516 | B2 | 8/2008 | Habing | |
| 7,572,190 | B2 * | 8/2009 | Habing | A63G 11/00 472/110 |

* cited by examiner

*Primary Examiner* — Michael Dennis
(74) *Attorney, Agent, or Firm* — Daniel Boudwin; Global Intellectual Property Agency

(57) ABSTRACT

A teeter-totter device is provided that includes an elongated beam with slidable weights to balance the load of one or more users on the beam. The device includes a base that rotatably supports the beam and acts as a fulcrum point for the beam to rotate. A seat is disposed on each end of the beam, and one or more channels extend along the length of the beam. Slidable weights are disposed within the channels and are movable along the beam and within the one or more channels, whereby weight along the beam is used to account for a single user, or two users of different weights using the device. The slidable weights are securable into a static position along the length of the channel, thereby adding weight to one side of the beam or the other based on the load in each seat.

7 Claims, 4 Drawing Sheets

TEETER-TOTTER DEVICE

CROSS REFERENCE TO RELATED APPLICATION

This application claims the benefit of U.S. Provisional Application No. 62/055,182 filed on Sep. 25, 2014. The above identified patent application is herein incorporated by reference in its entirety to provide continuity of disclosure.

BACKGROUND OF THE INVENTION

Field of the Invention

The present invention relates to recreational devices, including seesaws and teeter-totters. More particularly, the present invention relates to an adjustable teeter-totter device that includes one or more moveable weights that balance the weight of two riders thereon, or allow for a single rider to be counterbalanced by the movable weight.

Seesaw and teeter-totter devices are recreational devices that allow users to balance each other along a beam that is supported at its midpoint. Generally, users sit on opposite ends of the teeter-totter beam, and the beam pivots or rotates about the base such that one end of the beam is elevated as the opposing end is lowered. When a pair of users sits on the device, each user alternates between an elevated position and a lowered position. Devices of this type are a common and popular piece of playground equipment.

A known problem associated with teeter-totter devices arises when two users of different weight utilize the device. Teeter-totters are best suited for use by two users of roughly the same weight. When one user is considerably heavier than the other, the device may be harder to operate in an enjoyable manner. The user with the greater weight will cause the user of less weight to be consistently elevated, and the heavier user will control the motion of the device. Similarly, if only one user operates the device, that user will not be assisted elevating himself by an opposing weight, and moreover no weight will maintain him in an elevated position.

The present invention is provided to address this and other problems in the art of teeter-totters. The present invention furthermore introduces a new and novel teeter-totter device regardless of the above identifies problems. No part of this background section should be construed as limited to addressing only the cited problems. The present invention provides a recreational teeter-totter device with slidable weights. Slidable weights allow one or more users to enjoy user of the device by reducing weight imbalance on opposing ends thereof.

SUMMARY OF THE INVENTION

The following summary is intended solely for the benefit of the reader and is not intended to be limiting in any way. The present invention provides a new teeter-totter device that can be utilized for providing convenience for the user when used by one or more users.

It is therefore an object of the present invention to provide a new and improved teeter-totter device that has all of the advantages of the prior art and none of the disadvantages.

It is another object of the present invention to provide a teeter-totter device that can be used to balance the weight of one or more users along the device using slidable weights.

Another object of the present invention is to provide a teeter-totter device with an elongated beam having a length, a first end, a second end, and a middle. The base rotatably supports the elongated beam and acts as a fulcrum in which the beam pivots or rotates.

Yet another object of the present invention is to provide a teeter-totter device that comprises seats disposed along opposing ends of the elongated beam.

Another object of the present invention is to provide a teeter-totter device that comprises at least one slidable weight along the length of the elongated beam. The slidable weight is securable along the length of the elongated beam using a pin connection to operably affix the slidable weight at a desired position along the elongated beam.

Another object of the present invention is to provide a teeter-totter device whereby the fulcrum comprises a pin or revolute joint between the elongated beam and the base.

Another object of the present invention is to provide a teeter-totter device, whereby the elongated beam further comprises at least one elongated channel along the length thereof, and each slidable weight is slidable within one of the elongated channels.

Another object of the present invention is to provide a teeter-totter device, wherein each of the elongated channels may extend along the entire length of the elongated beam and each weight may be operably removable from the ends of the elongated beam. Moreover, each channel of the present invention may substantially constrain each slidable weight within the channel to accommodate sliding motion of each slidable weight along the length of the elongated beam.

Another object of the present invention is to provide a teeter-totter device, wherein the pin connection between each slidable weight and the elongated beam comprises a spring pin extending from each slidable weight, and the elongated beam includes a plurality of pin apertures adapted to receive a single spring pin.

Another object of the present invention is to provide a teeter-totter device, wherein the elongated beam may comprise a first tubular section and a second tubular section forming a first channel and a second channel, and wherein at least one slidable weight being disposed within each of the first channel and second channel.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
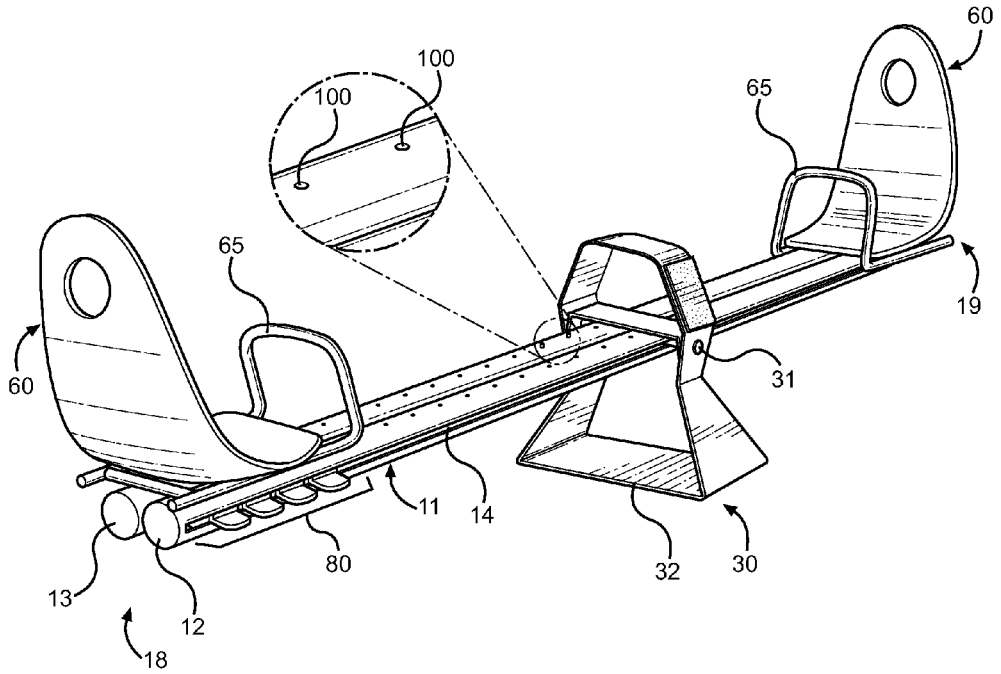
FIG. 1 shows a perspective view of an embodiment of the teeter-totter device of the present invention.

Reference is made herein to the attached drawings. Like reference numerals are used throughout the drawings to depict like or similar elements of the teeter-totter device of the present invention. For the purposes of presenting a brief and clear description of the present invention, the preferred embodiment will be discussed as used for allowing one or more users to enjoy the device while seated along the ends thereof. The figures are intended for representative purposes only and should not be considered to be limiting in any respect.

Referring now to FIG. 1, there is shown a perspective view of an embodiment of the teeter-totter device of the present invention. The device comprises an adjustable teeter-totter device with movable weights along the length thereof to balance one or more users seated on the ends of the device while in use. The device comprises an elongated beam 11 having a length, a first end 18, a second end 19, and a middle. Along the middle of the beam 11 is a base 30 that rotatably supports the central portion of the elongated beam such that the beam 11 can pivot thereabout and the ends of the device can alternate between an elevated position and a lowered position. The base 30 may connect at the midpoint of the elongated beam, or generally within the middle of the beam as defined as between the first and second end.

Along each end 18, 19 of the beam 11 is disposed a seat 60 upon which a user can sit and enjoy the teeter-totter device. The seats 60 are preferably disposed along the outermost ends of the beam 11 such that each user's weight bears on the outermost ends of the beam 11 and the users can be operatively placed in either the elevated or lowered position. However, it is contemplated that the seats may be positioned inboard of each end, or furthermore that the seat position may be adjustable along the length of the elongated beam 11. When a user is in each seat 60, their weights act against one another and the base 30 forms a fulcrum around which the beam can pivot or rotate. Each seat may further include a handle 65 for the user to grasp.

The base 30 is a structure that supports the middle of the elongated beam above the ground and provides a pin joint 31 or revolute joint connection for the beam to pivot about. The base 30 may include a lower surface 32 that bears against the ground, while the pin joint 31 forms the beam fulcrum point and connection between the beam 11 and the base 30. As the first end 18 of the beam is elevated, the second end 19 is lowered, and vice versa. Therefore, the beam length pivots about the pin joint 31 based on the motion of the users sitting in the seats and their relative weight.

To improve enjoyment of the device, slidable weights 80 are disposed along the length of the beam 11 such that one user can enjoy the device alone, or two users of different size may enjoy the device together and in a more balanced configuration across the beam length. In particular, the beam 11 further comprises at least one elongated channel 14 extending along the beam length. The at least one channel 14 may comprise a singular channel or multiple channels, and the length of the channel may extend the entire length of the beam 11 or may extend only to a given extent therealong. Additionally, the channel 14 may extend from the first end 18 to the second end 19 and may be continuous between the ends and across the base 30, or the channels may extend only along one side of the base 30 along the beam length.

The one or more channels 14 each accommodate at least one slidable weight 80 therein. The channels are partially enclosed areas within the cross section of the elongated beam 11 that support a slidable weight 80 that can slide within the channel 14 length. Access to each slidable weight is provided along a portion of the beam cross section, thereby allowing a user to grasp and slide each weight 80 along the channel length and position each weight according to the needs of the user or users.

Figure 2:
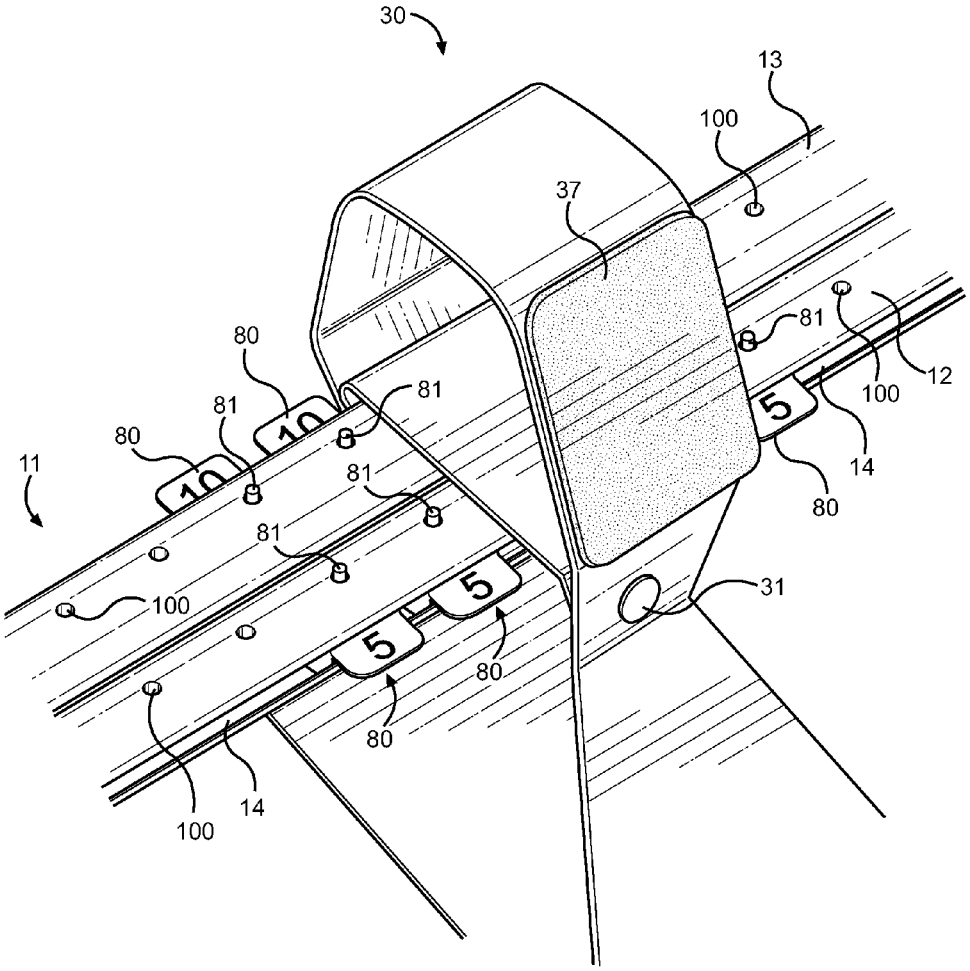
FIG. 2 shows an overhead perspective view of an embodiment of the base of the present invention.
Figure 3:
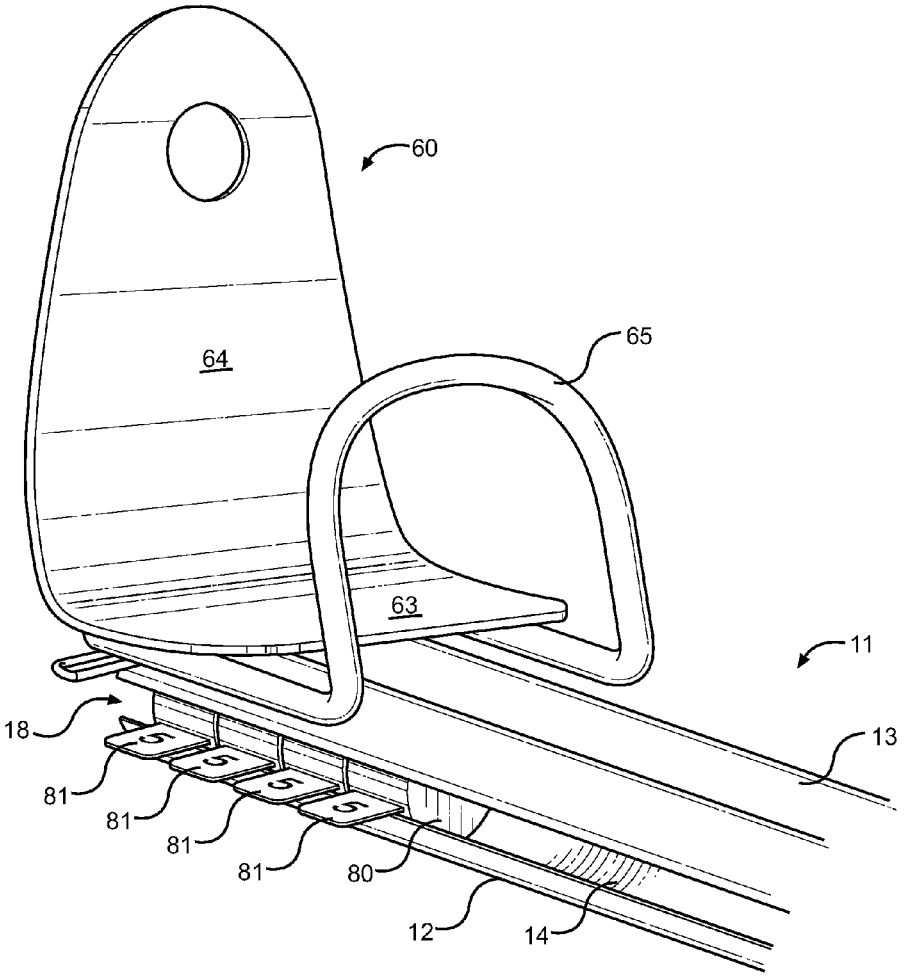
FIG. 3 shows a view of an embodiment of one end of the teeter-totter device.

Referring to FIGS. 1-3, additional views are provided that show embodiments of the elongated beam 11, the one or more channels 14, and the slidable weights 80. The depicted configurations of these elements are illustrative embodiments and are not intended to limit the claims to a singular embodiment. In particular, the figures show a beam having a first section 12 and a second section 13 that are tubular and disposed adjacent to one another. Each tubular section 12, 13 supports an elongated channel 14 along its length, which may extend up to and/or through the ends 18, 19 of the beam. Multiple slidable weights 80 are disposed within each channel, and the weights 80 can be secured along the beam length using a pin connection. This is but one configuration falling within the scope of the claimed invention. This embodiment is not intended to limit the embodiments falling within the claims.

The one or more elongated channels 14 of the present invention accommodate slidable weights 80 that can slide along the channel length and be positioned therealong to act as counterbalancing weights against one or more users. This is useful when one user is enjoying the device, or alternatively, when two users of different size enjoy the device. In this manner, the number of weights 80 and their position along the beam length balances the weight of the beam across the fulcrum point such that the beam is more balanced.

In one embodiment, the weights 80 include a pin connection 81 that is designed to engage an aperture 100 along the beam 11 length. The beam 11 includes a plurality of spaced apart apertures 100 to secure the weights. The arrangement, number, and spacing of the apertures 100 may vary depending on the design of the device. This includes equally spaced apart apertures 100 along the entire length of the beam 11 for each channel 14, or alternative apertures disposed adjacent to the ends and adjacent to the base to operably position the weights in the middle or along the ends of the beam only. It is not desired to limit the configuration of the weight apertures along the length of the beam, rather it is desired to contemplated apertures 100 adapted to support a pin 81 extending from the slidable weights 80 that is used to secure the weights 80 in a static position along the channel length when the beam 11 is being rotated and the teeter-totter device is in use. In a similar manner, the number of weights 80 and the mass of each weight 80 may vary depending on the design of the device. Moreover, the weights 80 may all be uniform in mass, or alternatively the plurality of weights may include different size weights that can be moved along the beam length.

FIG. 3 shows one embodiment of the slidable weights 80 disposed within the volume of the channel 14. In this view, the slidable weights 80 include a tab 81 that can be grasped and used to move the weight along the channel 14 length. The channels 14 extend along the beam 11 length and extend through the ends 18 thereof such that the weights can be removed from the beam 11. Further illustrated in FIG. 3 is a smooth upper surface to the beam length, whereby the pin connections between the weights 80 and the beam 11 are disposed along the underside of the beam 11. Finally, FIG. 3 shows an embodiment of the seat 60, whereby the seat may include a seat back 64, a seat base 63, and a seat handle 65.

Figure 4:
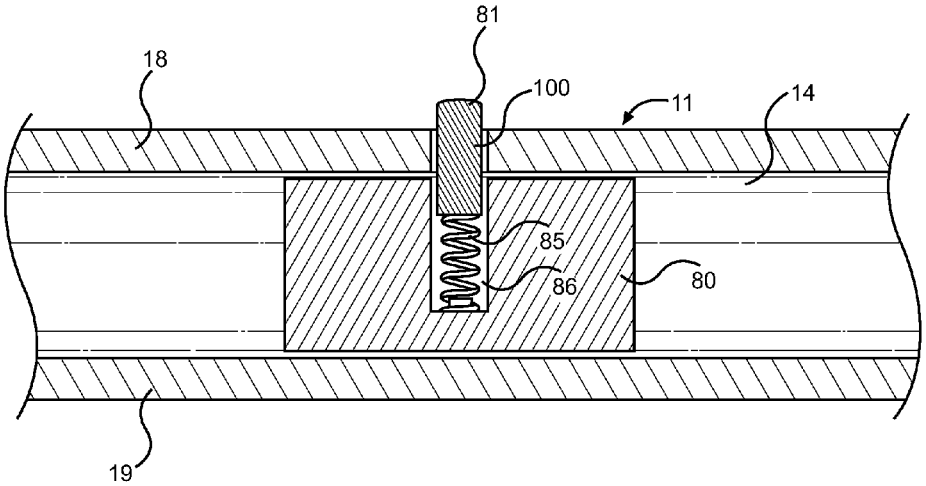
FIG. 4 shows a cross-section view of one embodiment of the slidable weight disposed within the channel of the elongated beam, along with a view of the spring pin connection between the beam and the weight.

Referring to FIG. 4, there is shown a cross-section view of another embodiment of the connection between the channel 14 and the slidable weights 80. In this embodiment, each of the slidable weights 80 includes a spring pin connection that can be used to secure the weight 80 to an aperture 100 along the length of the beam 11. Each weight 80 includes a body, a cavity 86 therein, a spring 85 or similar biased member, and a pin 81. The cavity 86 supports the spring 85 within its interior as the pin 81 extends from the cavity opening beyond the extent of the weight body such that the pin 81 is biased outward from the cavity 86. When the pin 81 is aligned with an aperture 100, the spring 86 biases the pin 81 into the aperture 100 and statically secures the weight 80 within the channel 14. The pin 81 extends from the cavity 86 of the weight 80 and into the aperture 100 to prevent sliding motion of the weight 80. The apertures 100 may be disposed within the channel sidewalls, upper surface 18, or lower surface 19.

Figure 5:
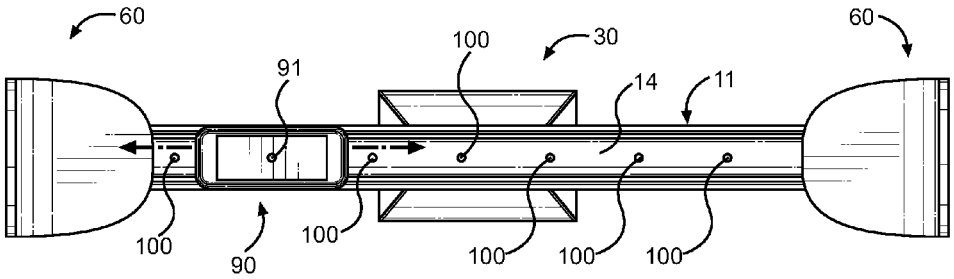
FIG. 5 shows an overhead view of another embodiment of the present invention, whereby a singular weight moves along a singular channel.

Finally, FIG. 5 illustrates a view of an embodiment of the teeter-totter device from an overhead perspective. In this embodiment, a singular weight 90 is disposed within a channel 14 and is slidable therealong. A pin connection 91 secures the weight 90 within apertures 100 therealong. In this embodiment, a singular channel 14 is provided along the beam 11, and the weight 90 can slide along the entire length of the beam 11. Consistent with other embodiments, the teeter-totter includes seats 60, a base 30, and an elongated beam 11.

The present invention provides a teeter-totter or seesaw device having movable weights thereon. The teeter-totter comprises an elongated beam or shaft that is pivotally mounted on a base. The base includes a pin joint that functions as a fulcrum or pivot point along the middle of the beam, and each end of the beam includes a seat thereon. Thus, users can sit on opposite ends of the see-saw facing one another and can alternate moving up and down. The beam includes a number of slidable weights thereon, wherein the weights can slide towards one end of the beam for the purpose of balancing the weight of one or more riders.

The elongated beam is pivotally mounted on the base in a substantially horizontal orientation when the beam is balanced. The elongated beam can pivot to various angles relative to a horizontal plane such that users on each end of the beam can move up and down. The pivot point may be located along the middle the elongated beam so that each end of the beam is of approximately the same length. The elongated beam further includes one or more channels in which a number of weights are positioned. The weights can slide along the length of the channels towards an end of the beam for the purpose of counterbalancing a single rider, or for compensating for the weight of a heavier rider. In this way, the teeter-totter allows a single user to ride a see-saw by himself or herself. Further, the weights can be shifted so as to compensate for the weight differential between two users. Each weight includes a pin thereon and can be locked in a desired position located on the elongated beam. Alternatives to the pin connection are contemplated, including various clips, clamps, and other fasteners for securing a slidable member within an elongated shaft.

Also provided on the teeter-totter may be a chalkboard 37, as illustrated in FIG. 2. The chalkboard 37 can be used as an additional play surface for drawing and the like. Alternatively, users may use the chalkboard to calculate the weight required to balance the teeter-totter riders. Additionally, a calculator can be supplied for helping the users to determine the weight required to balance two users.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable teeter-totter device, comprising: an elongated beam having a length, a first end, a second end, and a middle; a base that rotatably supports the middle of the elongated beam; said base forming a fulcrum; whereby the elongated beam is configured to rotate about the fulcrum; a first seat disposed on the first end of the elongated beam; a second seat disposed on the second end of the elongated beam; at least one slidable weight along the length of the elongated beam; the slidable weight having a removable pin connection with the elongated beam to operably affix the slidable weight at a desired position along the length of the elongated beam; wherein: the elongated beam further comprises at least one elongated channel along the length thereof; each slidable weight being slidable within one of the elongated channels; and wherein each elongated channel extends along the length of the elongated beam and each weight is operably removable from the first end or second end of the elongated beam; and wherein each channel sub substantially constrains each slidable weight within the channel and is configured to accommodate sliding motion of each slidable weight along the length of the elongated beam.

2. The adjustable teeter-totter device of claim 1, wherein the fulcrum comprises a pin joint between the elongated beam and the base.

3. The adjustable teeter-totter device of claim 1, wherein:

the removable pin connection between each slidable weight and the elongated beam comprises a spring pin extending from each slidable weight, and a plurality of pin apertures adapted to receive a single spring pin along the length of the elongated beam.

4. The adjustable teeter-totter device of claim 1, wherein:

the removable pin connection between each slidable weight and the elongated beam secures to one of a plurality of pin apertures along the length of the elongated beam that are adapted to receive a single pin.

5. The adjustable teeter-totter device of claim 1, wherein the at least one slidable weight comprises a singular weight that is slidable along the entire length of the elongated beam and across the fulcrum.

6. The adjustable teeter-totter device of claim 1, wherein the at least one slidable weight comprises two or more weights that are slidable along the length.

7. The adjustable teeter-totter device of claim 1, wherein:

the elongated beam comprises a first tubular section and a second tubular section forming a first channel and a second channel;

at least one slidable weight being disposed within each of the first channel and second channel.

* * * * *